US007264508B2

(12) United States Patent
Sakakura et al.

(10) Patent No.: US 7,264,508 B2
(45) Date of Patent: Sep. 4, 2007

(54) SHIELDED CONNECTOR, MATING SHIELDED CONNECTOR AND SHIELDED CONNECTOR ASSEMBLY

(75) Inventors: Kouji Sakakura, Yokkaichi (JP); Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/342,149

(22) Filed: Jan. 26, 2006

(65) Prior Publication Data

US 2006/0172600 A1 Aug. 3, 2006

(30) Foreign Application Priority Data

Feb. 1, 2005 (JP) ..... 2005-025522

(51) Int. Cl.
*H01R 13/648* (2006.01)

(52) U.S. Cl. ..... 439/607; 439/680

(58) Field of Classification Search ..... 439/607, 439/680, 610, 497, 157, 677, 701, 248, 347, 439/160, 159, 578–579, 247, 352, 372
See application file for complete search history.

(56) References Cited

U.S. PATENT DOCUMENTS 5,149,283 A 9/1992 Nakazawa
5,997,349 A * 12/1999 Yoshioka ..... 439/579
6,139,351 A 10/2000 Schaefer et al.
6,358,089 B1 * 3/2002 Kuroda et al. ..... 439/607
6,644,992 B2 * 11/2003 Maegawa ..... 439/157
6,666,728 B2 * 12/2003 Taichi et al. ..... 439/701
2002/0182908 A1 * 12/2002 Maegawa ..... 439/157
2004/0110425 A1 * 6/2004 Miyake et al. ..... 439/677

FOREIGN PATENT DOCUMENTS

JP 2002-319458 10/2002

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

A shielded connector assembly has first and second housings (11, 31). The first housing (11) has a fitting space (17) formed with coupling ribs (16). A shielding shell (26) is in the fitting space (17) and has slits (27) that receive the coupling ribs (16). A preventing groove (29) is formed in a peripheral surface of a fitting space (17) and receives a projection (37) of the second housing (31) when the housings (11, 31) are connected properly. The preventing groove (29) is aligned with the slit (27) so that the slit (27) also receives the projection (37). Thus, it is unnecessary to form a separate notch to receive the projection (37).

7 Claims, 10 Drawing Sheets

SHIELDED CONNECTOR, MATING SHIELDED CONNECTOR AND SHIELDED CONNECTOR ASSEMBLY

BACKGROUND OF THE INVENTION

1. Field of the Invention

The invention relates to a shielded connector, to a mating shielded connector connectable therewith and to a shielded connector assembly.

2. Description of the Related Art

A known shielded connector has terminal fittings accommodated in a housing made of a synthetic resin. The connector further includes a tubular metallic shielding shell assembled into the housing to absorb noise from the terminal fittings and to prevent leakage of noise to the outside of the housing.

The housing of one known shielding connector has a terminal accommodating portion surrounded by a tubular fitting. The outer peripheral surface of the terminal accommodating portion and the inner peripheral surface of the tubular fitting are coupled by a coupling rib, and a fitting space is defined between the terminal accommodating portion and the tubular fitting portion for accommodating a shielding shell. The shielding shell is formed with a slit that receives the coupling rib as the shielding shell is inserted into the fitting space.

The above-described shielded connector is used with a mating shielded connector as a mating partner of this shielded connector that has terminal fittings accommodated in a housing. Outer surfaces of the housing and a receptacle formed on the housing are surrounded by a shielding shell. The receptacle is fit into the fitting space when the housing and the mating housing are connected to bring both shielding shells into contact so that the peripheral surfaces of the shielding shells overlap.

Japanese Unexamined Patent Publication No. 2002-319458 discloses a shielded connector with many of the features described above.

Most connector assemblies have a projection formed on the outer peripheral surface of one connector and a groove formed in a fitting space of the other connector. The projection and the groove prevent the connectors from being connected erroneously in an inverted orientation.

The above-described erroneous connection preventing means could be applied to shielded connectors. However, the shielding shell would have to be formed with a notch for avoiding interference with the projection in addition to the slit for avoiding the interference with the coupling rib. The slit and the notch can be paths for leaking noise to the outside of the shielding shells. Thus, a shielding function of the shielding shells may be reduced.

The present invention was developed in view of the above problem, and an object thereof is to suppress a reduction in a shielding function.

SUMMARY OF THE INVENTION

The invention relates to a shielded connector that is connectable with a mating shielded connector. The shielded connector has a housing with at least one terminal accommodating portion that is at least partly surrounded by a tubular fitting. The outer peripheral surface of the terminal accommodating portion and the inner peripheral surface of the tubular fitting are coupled by at least one coupling rib so that a fitting space is defined between the terminal accommodating portion and the tubular fitting. The connector further includes a substantially tubular shielding shell formed with at least one slit extending from an end edge of the shielding shell. The shielding shell is mounted in the fitting space so that the slit engages the coupling ribs. The mating shielded connector has a mating housing that is configured to fit into the fitting space. The peripheral surface of the fitting space where the shielding shell is provided is formed with at least one erroneous connection preventing portion for preventing an improper assembling of the housing with the mating housing. The erroneous connection preventing portion is at a location in the fitting space substantially corresponding to the slit.

The erroneous connection preventing portion may comprise a projection and/or a recess.

The shielded connector preferably is connectable to the mating shielded connector by at least partly overlapping the peripheral surfaces of the shielding shell with a mating shielding shell of the mating shielded connector.

A movable member such as a lever or a slider preferably is provided and displays a cam action to assist or perform the connection of the shielded connector with the mating shielded connector.

The invention also relates to a shielded connector assembly comprising the above-described shielded connector and a mating shielded connector that are connectable with each other.

The mating shielded connector preferably has a mating housing, and a mating shielding shell surrounds the second housing. The shielded connectors are connected by fitting the mating housing into the fitting space and overlapping the peripheral surfaces of the shielding shells. The fitting space and the mating housing have erroneous connection preventing portions in the form of a projection and a recess for preventing an improper assembly of the housings. The erroneous connection preventing portion of the fitting space is at a position corresponding to the slit.

The shielding shell must have a notch corresponding to the erroneous connection preventing portion of the fitting space to engage the erroneous connection preventing portion of the mating housing. According to the invention, the erroneous connection preventing portion of the fitting space is disposed to correspond to the slit. The slit for avoiding interference with the coupling rib also is the notch for engaging the erroneous connection preventing portions. Thus, it is not necessary to form the notch and a separate slit and noise leakage paths are reduced.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
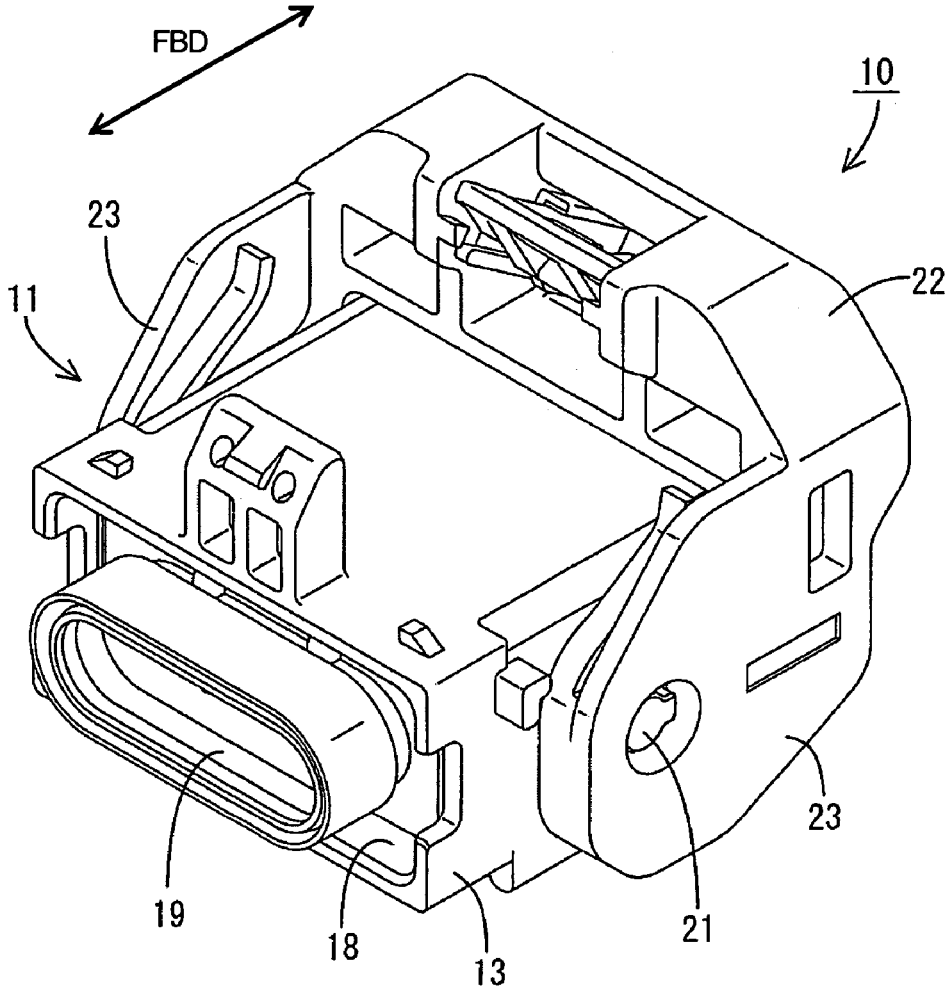
FIG. 1 is a perspective view of a first shielded connector.
Figure 2:
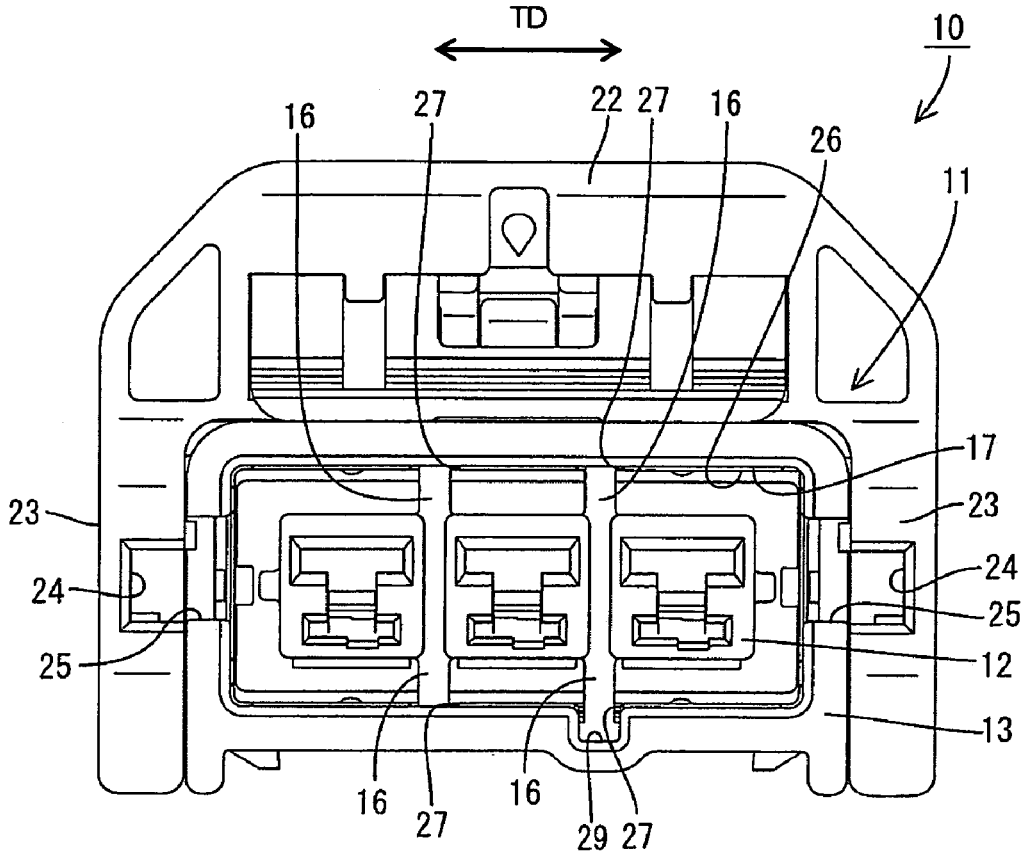
FIG. 2 is a front view of the first shielded connector.
Figure 3:
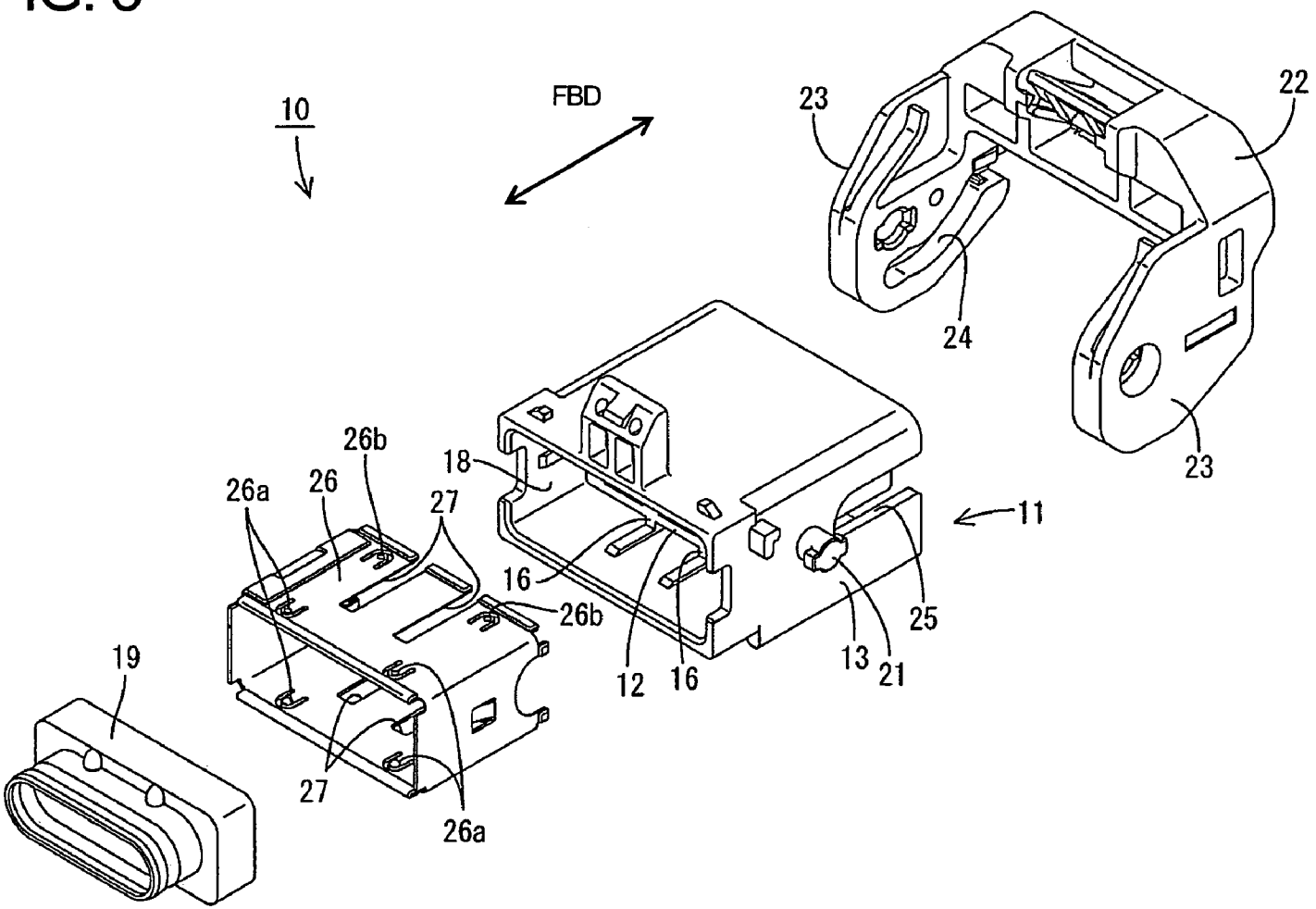
FIG. 3 is an exploded perspective view of the first shielded connector.
Figure 4:
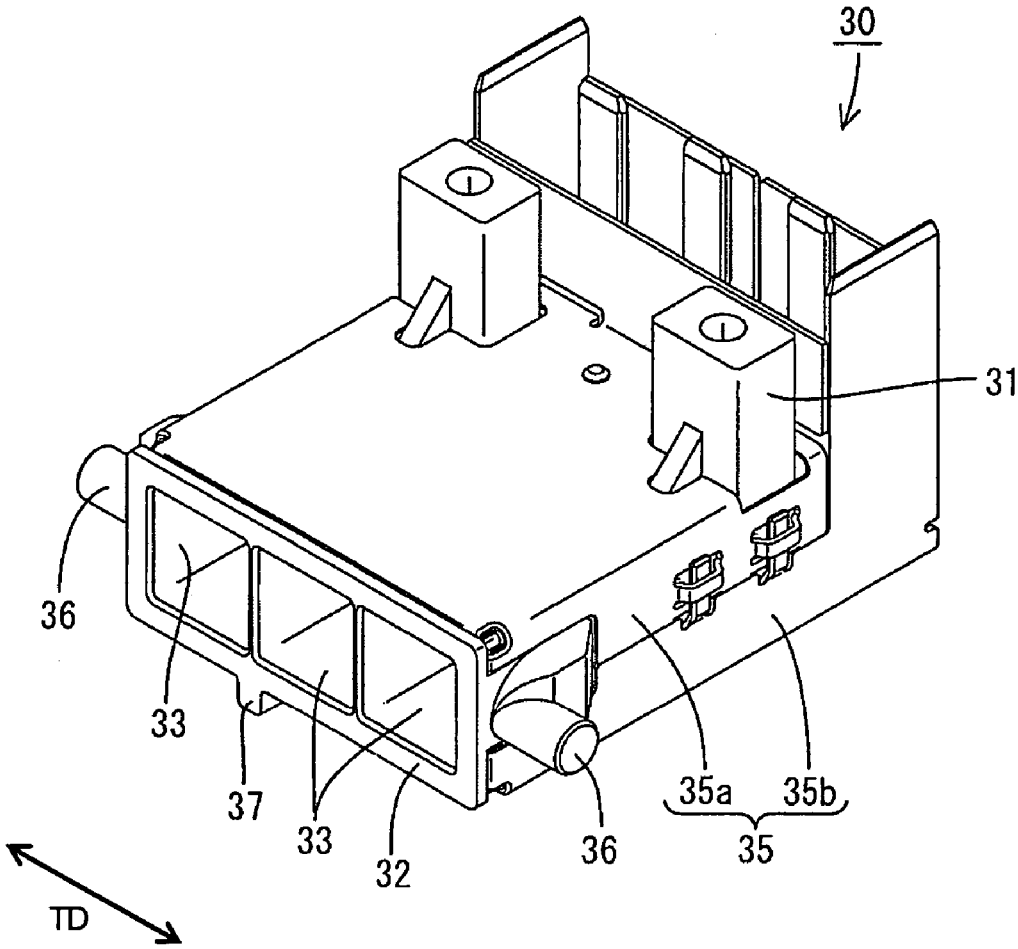
FIG. 4 is a perspective view of a second shielded connector.
Figure 5:
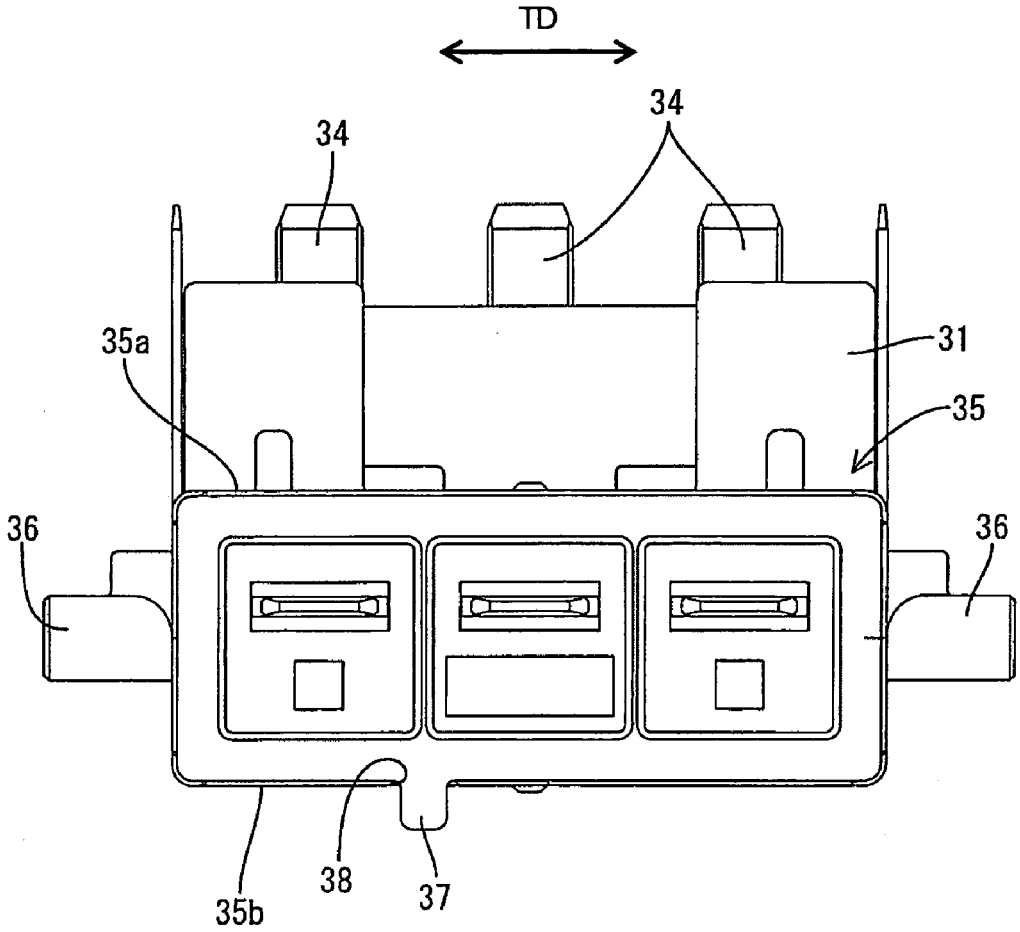
FIG. 5 is a front view of the second shielded connector.
Figure 6:
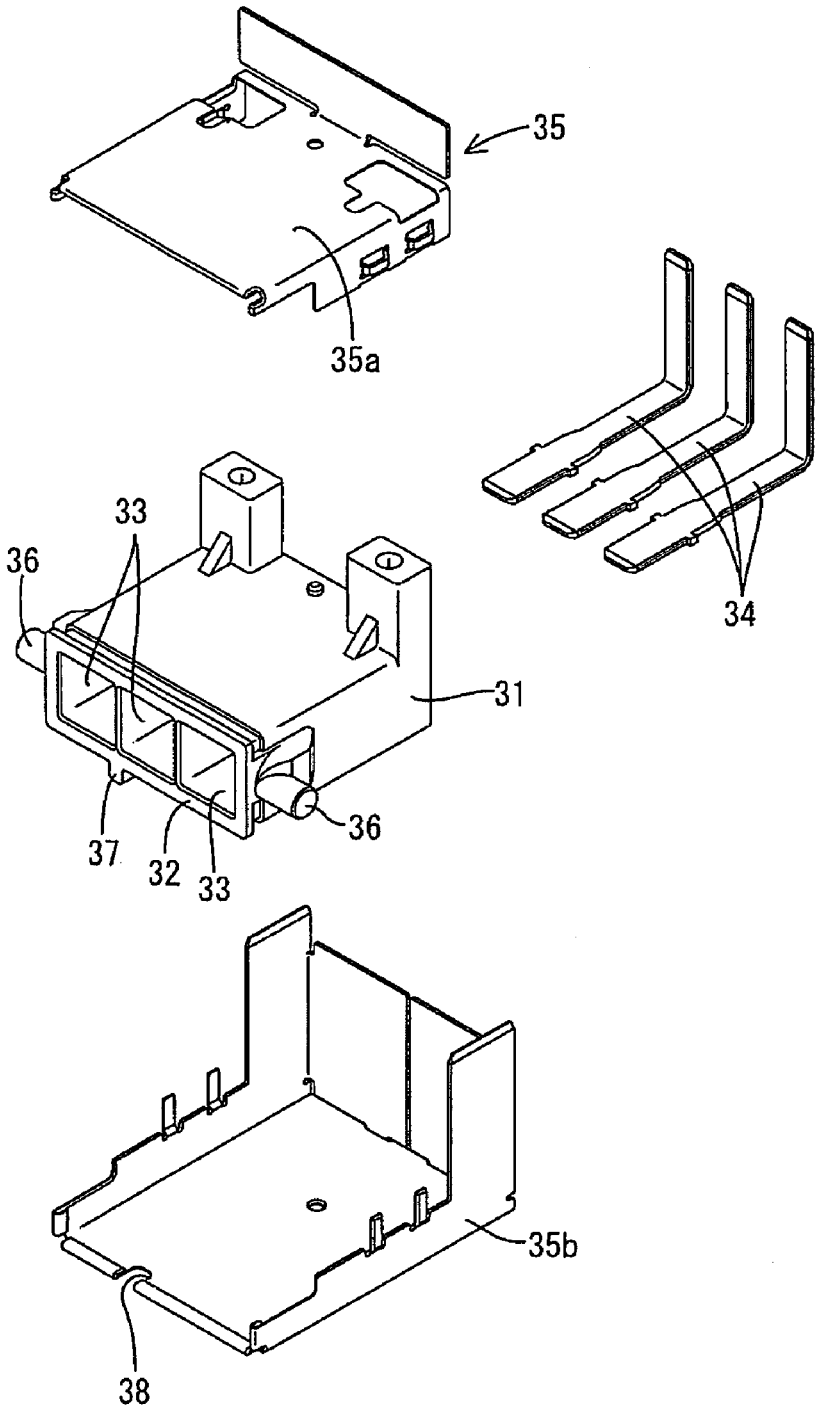
FIG. 6 is an exploded perspective view of the second shielded connector.
Figure 7:
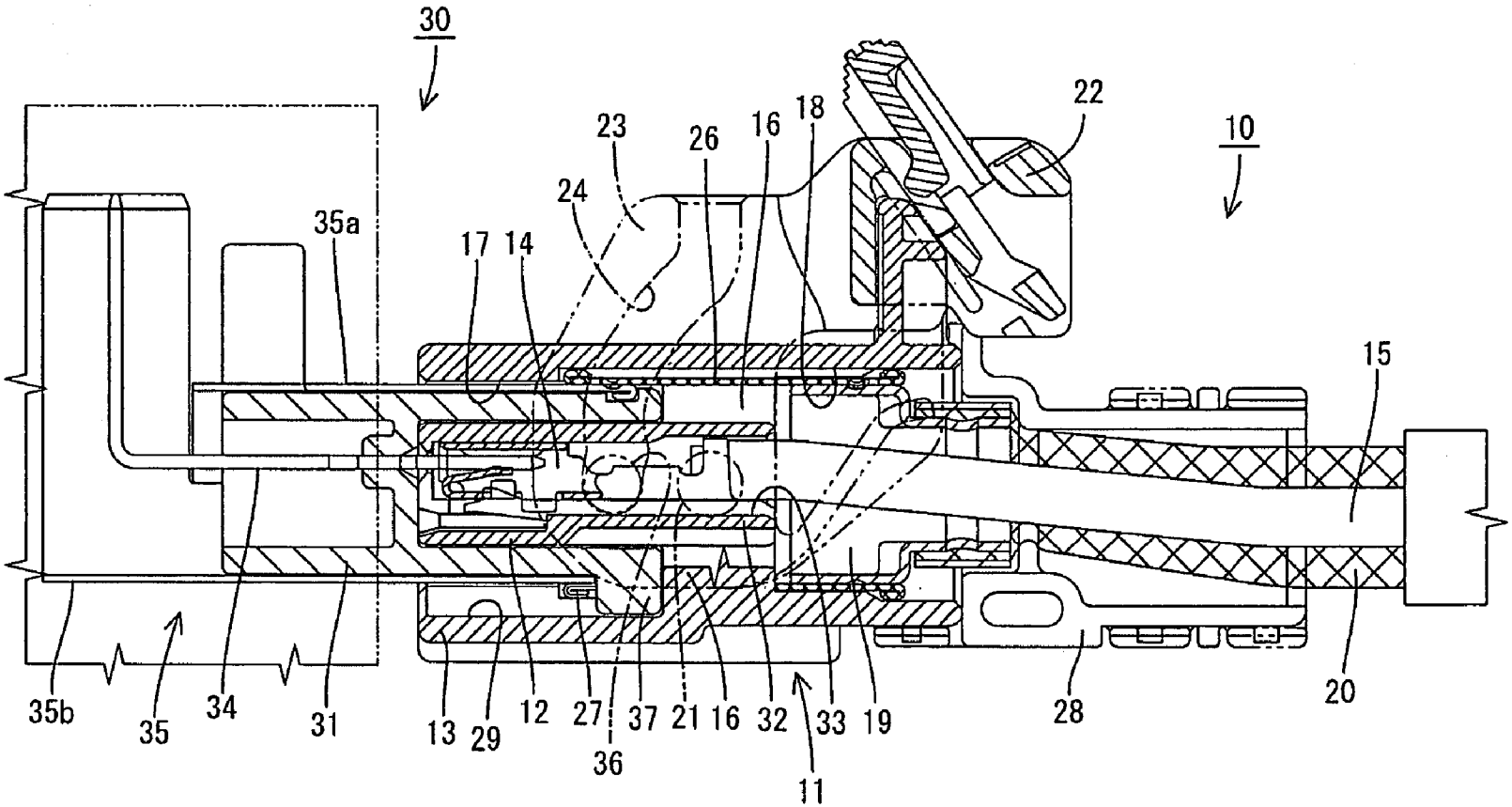
FIG. 7 is a vertical section showing a state where the two shielded connectors are connected.
Figure 8:
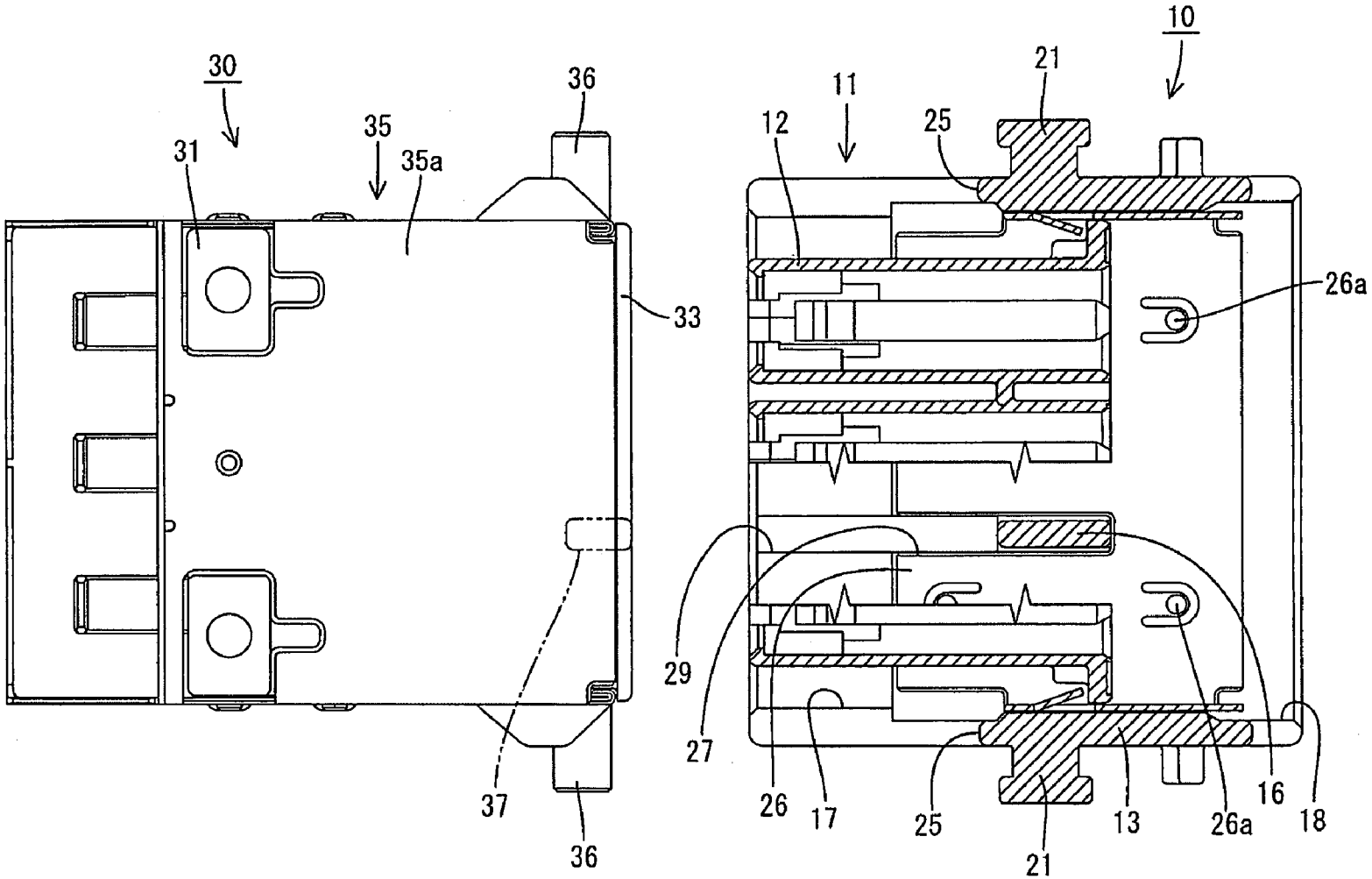
FIG. 8 is a horizontal section showing a state where the two shielded connectors are separated.
Figure 9:
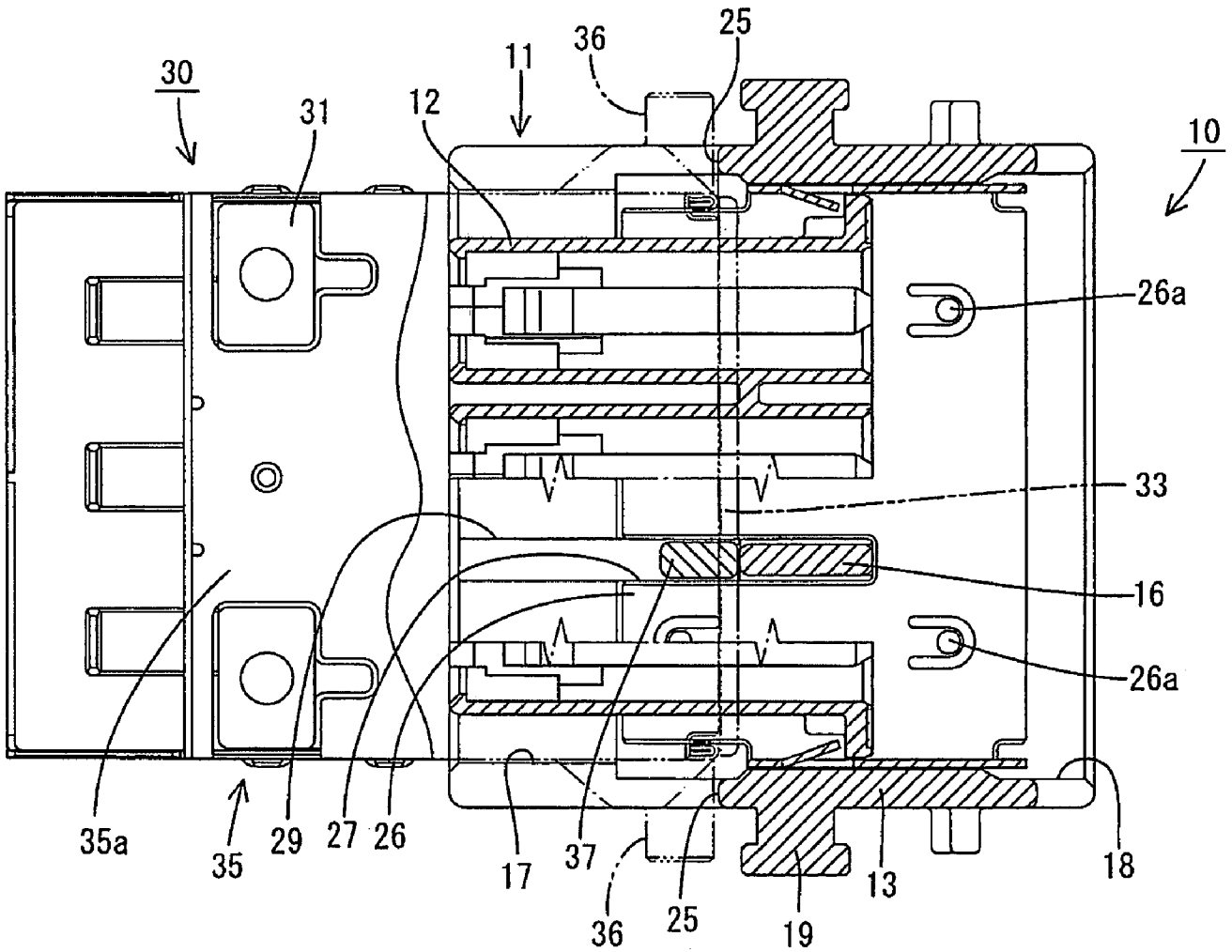
FIG. 9 is a horizontal section showing the state where the two shielded connectors are connected.
Figure 10:
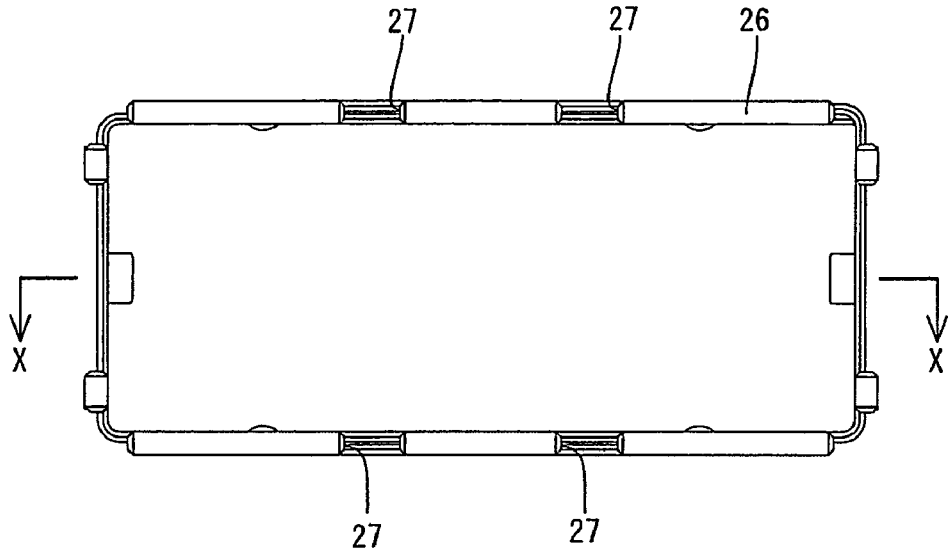
FIG. 10 is a front view of a first shielding shell.
Figure 11:
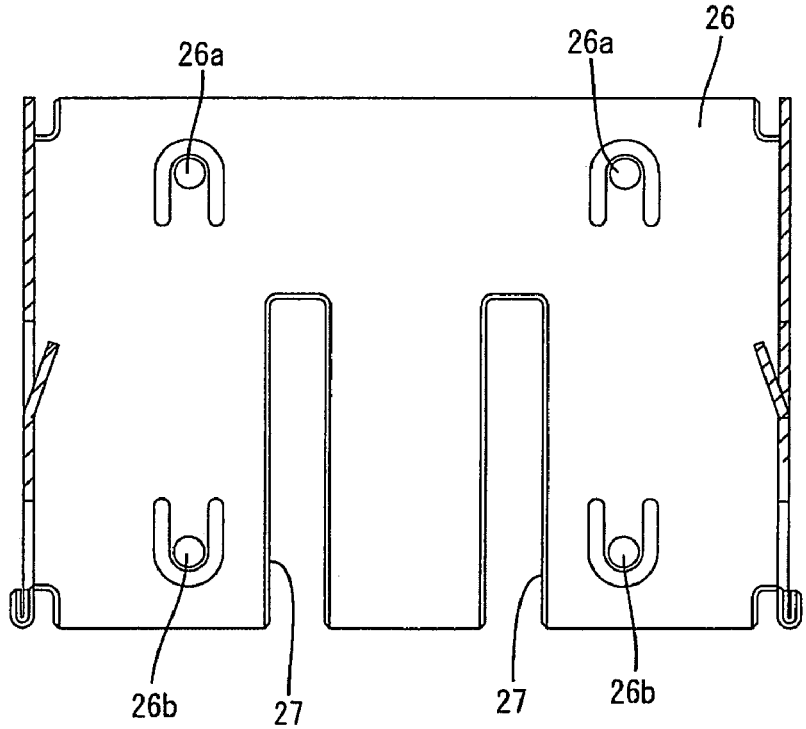
FIG. 11 is a section along X—X of FIG. 10.

A shielded connector assembly according to the invention has first and second shielded connectors 10 and 30, as shown in FIGS. 1 to 11. The first and second shielded connectors 10 and 30 are configured to be connected with and separated from each other. Mating sides of the first and second shielded connectors 10 and 30 are referred to as the front herein.

The first shielded connector 10 includes a first housing 11 that is molded integrally or unitarily of e.g. a synthetic resin. The first housing 11 has block-shaped terminal accommodating portions 12 and a rectangular tubular fitting 13 that substantially surrounds the terminal accommodating portions 12. The terminal accommodating portions 12 are arranged substantially side-by-side and are coupled to one another at their rear ends. First terminal fittings 14 are inserted into the respective terminal accommodating portions 12 from behind. An unshielded wire 15 is connected with the rear end of each first terminal fitting 14, and is drawn out of the first housing 11 through the rear end of the terminal accommodating portion 12.

The tubular fitting 13 extends in forward and backward directions FBD from the front ends of the terminal accommodating portions 12 to a position behind the rear ends of the terminal accommodating portions 12. Left and right coupling ribs 16 are formed at the rear ends of upper and lower outer peripheral surfaces of the terminal accommodating portions 12 to couple the terminal accommodating portions 12 and the tubular fitting 13 and to hold a specified positional relationship. A substantially rectangular fitting space 17 is defined between the outer peripheral surfaces of the terminal accommodating portions 12 and the tubular fitting 13. The fitting space 17 has an open front end and is substantially continuous over substantially the entire periphery. An accommodation space 18 is defined in area in the tubular fitting 13 behind the terminal accommodating portions 12 for accommodating a connection shell 19. The connection shell 19 is to be secured to an end of a shielding layer 20 (e.g. a braided wire or a metal shielding layer) for surrounding and shielding the wires 15 drawn out backward from the first housing 11.

A lever 22 is mounted on the first housing 11 and is rotatable about supporting shafts 21 formed on the left and right outer surfaces of the tubular fitting 13. Plate-like left and right arms 23 of the lever 22 are arranged along the outer side surfaces of the tubular fitting 13, and cam grooves 24 are formed in the surfaces of the arms 23 facing the tubular fitting 13. On the other hand, the tubular fitting 13 is formed with escaping grooves 25 that are substantially straight cuts formed to extend back from the front ends of the left and right walls of the tubular fitting 13.

The first connector 10 further has a rectangular tubular first shell 26 preferably formed by deep drawing a metal sheet (e.g. an aluminum alloy) to gradually deform the metal sheet by repeating a plurality of pressing operations. Thus, the tubular first shell 26 has no seam in the peripheral direction. Left and right slits 27 extend back from the front ends of the upper and lower plates of the first shielding shell 26 at positions corresponding to the coupling ribs 16. The front end of the first shielding shell 26 is located at a position slightly behind the escaping grooves 25 of the tubular fitting 13.

The first shielding shell 26 is mounted into the fitting space 17 of the first housing 11 substantially along the inner peripheral surface of the tubular fitting 13 from behind. In the assembling process, the slits 27 engage the coupling ribs 16. When the first shielding shell 26 reaches a proper assembled position, the outer peripheral surface of the first shielding shell 26 is held in close contact with a great part of the inner peripheral surface of the tubular fitting 13, a front part of the first shielding shell 26 is in a rear part of the fitting space 17, and a rear part of the first shielding shell 26 is in the accommodation space 18. The first shielding shell 26 shields rear parts of the first terminal fittings 14 inserted in the terminal accommodating portions 12 and areas of the wires 15 accommodated in the tubular fitting 13 by surrounding them substantially over the entire periphery.

The connection shell 19 is mounted into the accommodation space 18 from behind so that the outer peripheral surface of the connection shell 19 at least partly overlaps the inner peripheral surface of the rear end of the first shielding shell 26. Resilient contact pieces 26*a* are formed close to the rear end of the first shielding shell 26 and contact the outer surfaces of the connection shell 19 to electrically connect the first shielding shell 26 and the connection shell 19. The connection shell 19 is retained by a holder 28 mounted to the rear end of the first housing 11.

The second shielded connector 30 includes a second housing 31 made e.g. of a synthetic resin. A receptacle 32 is formed at the front of the second housing 31 and is configured to fit in the fitting space 17. The receptacle 32 is partitioned into three fitting recesses 33 having opening front ends, and long narrow second (male) terminal fittings 34 are accommodated in the respective fitting recesses 33. A rectangular tubular second shielding shell 35 is mounted in close contact with the outer peripheral surface of the second housing 31. The second shielding shell 35 is a united assembly of upper and lower divided elements 35*a*, 35*b*, and surrounds the entire area of the second housing 31 from the front end to the rear end over substantially the entire periphery. Cylindrical cam followers 36 project out from the left and right outer side surfaces of the second housing 31, and parts of the second shielding shell 35 corresponding to the cam followers 36 are notched.

Means also are provided for preventing connection of shielding connectors 10, 30 in improper postures or in an improper combination.

The first shielding connector 10 is formed with a preventing groove 29 of substantially rectangular cross section in the inner peripheral surface of the tubular fitting 13, which is the peripheral surface on which the first shielding shell 26 is arranged. The preventing groove 29 is a substantially straight cut extending back from the front end of the tubular fitting 13 and is in an area from the front end of the tubular fitting 13 to the coupling ribs 16. The preventing groove 29 is at a position substantially corresponding to the coupling ribs 16 with respect to transverse direction TD, and the width of the preventing groove 29 is substantially equal to the widths of the coupling ribs 16 and the slits 27. Thus, the preventing groove 29 is located to correspond to the slit 27 and the coupling rib 16 is behind and on an extension of the preventing groove 29.

On the other hand, the second shielded connector 30 has a least one projection 37 at the front end of the outer lower surface of the receptacle 32. A front end of the second shielding shell 35 has a notch 38 only in an area where the projection 37 is formed. The projection 3 projects out and down through the notch 38. If the first and second shielded connectors 10, 30 are connected in a correct combination and in substantially proper postures (e.g. without being vertical inverted), the connecting operation of the two shielded connectors 10, 30 progresses as the projection 37 is fit into the preventing groove 29. Conversely, if an attempt is made to connect the first and second shielded connectors 10, 30 in a wrong combination or in improper postures (e.g. vertically inverted), the projection 37 contacts the front edge of the tubular fitting 13, to hinder the connection of the two shielded connectors 10, 30.

Upon connecting the two shielded connectors in a correct combination and in substantially proper postures, the receptacle 32 is fit lightly into the fitting space 17 and the terminal accommodating portions 12 are fit lightly into the fitting recesses 33 while the projection 37 engages the preventing groove 29 and the slit 27. The cam followers 36 then enter the cam grooves 24. The movable member 22 then is operated, and the shielded connectors 10, 30 are pulled together by a cam action resulting from the engagement of the cam followers 36 and the cam grooves 24 to assist the connecting operation. During the connecting operation, the front part of the second shielding shell 35 enters the front part of the inner space of the first shielding shell 26 so that the outer peripheral surface of the second shielding shell 35 and the inner peripheral surface of the first shielding shell 26 overlap.

With the two shielded connectors 10, 30 connected, the second shielding shell 35 is partly inside the first shielding shell 26, and the front ends of the two shielding shells 26, 35 overlap in longitudinal and transverse directions. Further, the resilient contact pieces 26*b* at the front end of the first shielding shell 26 resiliently contact the outer peripheral surface of the second shielding shell 35 so that the two shielding shells 26, 35 are connected electrically. In addition, front ends of the second terminal fittings 34 enter the terminal accommodating portions 12 to be connected electrically with the first terminal fittings 14. The rear parts of the first terminal fittings 14 are surrounded by the first shielding shell 26 as described above. By connecting the two shielded connectors 10, 30, front parts of the first terminal fittings 14 are surrounded by the second shielding shell 35. In this way, conduction paths formed by the terminal fittings 14, 34 in the first and second housings 11, 31 are substantially shielded by the two shielding shells 26, 35.

As described above, the preventing groove 29 is formed in the peripheral surface of the fitting space 17 and specifically in the inner peripheral surface of the tubular fitting 13. Thus, the first shielding shell 26 needs to be formed with the notch corresponding to the preventing groove 29 to enable the engagement of the preventing groove 26 with the projection 37 as the error connection preventing portion of the second housing 31. However, the preventing groove 29 corresponds to one of the slits 27. Thus, the slit 27 is the means for avoiding the interference with the coupling rib 16 and also is the notch for enabling the engagement of the projection 37 and the preventing groove 29. Accordingly, the first shielding shell 26 needs not be formed with a notch in addition to the slits 27, thereby avoiding an increase in noise leakage paths in the first shielding shell 26 to suppress a reduction in the shielding function by the first shielding shell 26.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the first and second shielded connectors are connected using the lever in the foregoing embodiment, the invention is also applicable to connect the first and second shielded connectors without using the lever or having other movable members such as sliders for assisting or performing the connection of the first and second shielded connectors.

Although one projection and one preventing groove are provided as the erroneous connection preventing portions in the foregoing embodiment, a plurality of projections or ribs and/or a plurality of preventing grooves or recesses may be provided according to the present invention.

Although the first shielding shell and the erroneous connection preventing portion extend substantially along the inner peripheral surface of the tubular fitting in the foregoing embodiment, they may be provided to extend along the outer peripheral surfaces of the terminal accommodating portions.

Although the erroneous connection preventing portion of the fitting space is the preventing groove and that of the second housing is the projection in the foregoing embodiment, the erroneous connection preventing portion of the fitting space may be the projection and that of the second housing may be the preventing groove according to the invention.

What is claimed is:

1. A shielded connector for connection with a mating shielded connector, the shielded connector comprising:

a housing with opposite front and rear ends, at least one terminal accommodating portion, a tubular fitting at least partly surrounding the terminal accommodating portion, a fitting space defined between the terminal accommodating portion and the tubular fitting, the fitting space being open at the front and rear ends of the housing, portions of the fitting space adjacent the front end of the housing being configured for receiving a mating housing of the mating shielded connector, at least one coupling rib spaced rearward of the front end of the housing and unitarily coupling an outer peripheral surface of the terminal accommodating portion and an inner peripheral surface of the tubular fitting;

a substantially tubular shielding shell with a front end edge and at least one slit extending rearwardly from the front end edge, the shielding shell being mounted in the fitting space from the rear end of the housing so that the slit receives the coupling rib; and at least one erroneous connection preventing recess formed in the tubular fitting adjacent the front end of the housing and being opened into the fitting space at a position substantially corresponding to the slit and the coupling rib for preventing improper assembly of the housing with the mating housing.

2. The shielded connector of claim 1, wherein the at least one erroneous connection preventing recess extends from the front end of the housing substantially to the coupling rib.

3. The shielded connector according of claim 1, wherein the shielded connector is connectable to the mating shielded connector by at least partly overlapping the peripheral surfaces of the shielding shell with a mating shielding shell of the mating shielded connector.

4. The shielded connector of claim 1, further comprising a movable member for displaying a cam action to assist connection of the shielded connector with the mating shielded connector.

5. A shielded connector assembly comprising:

a first shielded connector having a first housing with opposite front and rear ends, at least one terminal accommodating portion, a tubular fitting substantially surrounding the terminal accommodating portion, a fitting space defined between the terminal accommodating portion and the tubular fitting, the fitting space being opened at the front and rear ends of the housing, at least one coupling rib spaced rearward of the front end housing and unitarily coupling an outer peripheral surface of the terminal accommodating portion and an inner peripheral surface of the tubular fitting, a substantially tubular first shielding shell mounted in the fitting space from the rear of the housing, the first shielding shell having front end edge and at least one slit extending rearwardly from the front end edge, the coupling rib being disposed in the slit, at least one erroneous connection preventing recess formed in the tubular fitting adjacent the front end of the housing and opened into the fitting space at a position substantially corresponding to the slit and to the coupling rib; and a second shielded connector having a second housing configured for fitting into the fitting space from the front end of the first housing, a second shielding shell at least partly surrounding the second housing, the second housing being formed with at least one erroneous connection preventing projection at a position substantially corresponding to the slit and the erroneous connection preventing recess, the erroneous connection preventing projection being received in the slit and the erroneous connection preventing recess for preventing an improper connection of the first and second housings.

6. The shielded connector assembly of claim 5, wherein a front part of the second shielding shell is configured for entering a front part of an inner space of the first shielding shell during connection of the first and second shielded connectors.

7. The shielded connector assembly of claim 5, further comprising a movable member mounted movably to one of the first and second housings and configured displaying a cam action for assisting connection of the two shielded connectors.

* * * * *